US010041459B2

(12) United States Patent
Schuerg et al.

(10) Patent No.: US 10,041,459 B2
(45) Date of Patent: Aug. 7, 2018

(54) PRESSURE CONTROL VALVE FOR A FUEL INJECTION SYSTEM

(71) Applicant: Robert Bosch GmbH, Stuttgart (DE)

(72) Inventors: Stefan Schuerg, Ludwigsburg (DE); Vittorio Caroli, Ditzingen-Heimerdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/655,824

(22) PCT Filed: Nov. 7, 2013

(86) PCT No.: PCT/EP2013/073294
§ 371 (c)(1),
(2) Date: Oct. 13, 2015

(87) PCT Pub. No.: WO2014/102028
PCT Pub. Date: Jul. 3, 2014

(65) Prior Publication Data

US 2016/0123289 A1 May 5, 2016

(30) Foreign Application Priority Data

Dec. 27, 2012 (DE) ..... 10 2012 224 403

(51) Int. Cl.
*F02M 61/16* (2006.01)
*F02M 63/00* (2006.01)
(Continued)

(52) U.S. Cl.
CPC .... *F02M 63/0052* (2013.01); *F02M 63/0036* (2013.01); *F02M 63/0071* (2013.01);
(Continued)

(58) Field of Classification Search
CPC ..... F02M 63/0036; F02M 63/0071; F02M 61/162; F02M 61/163; F02M 47/027;
(Continued)

(56) References Cited

U.S. PATENT DOCUMENTS 4,974,565 A * 12/1990 Hashimoto ..... F02B 1/04 239/464
6,189,816 B1 * 2/2001 Stier ..... B24B 15/02 239/533.2
(Continued)

FOREIGN PATENT DOCUMENTS

CN 1205761 A 1/1999
CN 103180599 A 6/2013
(Continued)

OTHER PUBLICATIONS

International Search Report corresponding to PCT Application No. PCT/EP2013/073294, dated Jan. 17, 2014 (German and English language document) (5 pages).
(Continued)

*Primary Examiner* — Alexander Valvis
(74) *Attorney, Agent, or Firm* — Maginot, Moore & Beck LLP

(57) ABSTRACT

A pressure control valve for a fuel injection system, in particular a common-rail injection system, for controlling pressure in a high-pressure fuel reservoir, includes a magnetic actuator configured to actuate a spherical valve closing element. The magnetic actuator interacts with a reciprocatingly displaceable armature that is connected to an armature pin in order to transmit a force of the magnetic actuator to the spherical valve closing element. At least one of the spherical valve closing element and the armature pin is
(Continued)

axially displaceably guided in a valve piece which forms a valve seat configured to interact with the spherical valve closing element.

14 Claims, 3 Drawing Sheets

(51) Int. Cl.
*F02M 63/02* (2006.01)
*F02M 47/02* (2006.01)
*F02M 61/18* (2006.01)

(52) U.S. Cl.
CPC ..... *F02M 63/025* (2013.01); *F02M 47/027* (2013.01); *F02M 61/18* (2013.01)

(58) Field of Classification Search
CPC ..... F02M 63/0017; F02M 63/0022; F02M 2547/003; F02M 63/0052
See application file for complete search history.

(56) References Cited

U.S. PATENT DOCUMENTS 6,644,269 B2 * 11/2003 Kato ..... F02D 41/3827 123/305
6,776,358 B2 * 8/2004 Arimoto ..... F02M 61/042 239/533.3
6,823,833 B2 * 11/2004 Ismailov ..... F02D 41/40 123/299
2011/0233311 A1 * 9/2011 Fujita ..... F02M 61/042 239/584
2014/0070031 A1 * 3/2014 Lowry ..... F01N 3/2066 239/585.1

FOREIGN PATENT DOCUMENTS

| | | | |
|---|---|---|---|
| DE | 197 57 117 | A1 | 6/1999 |
| DE | 10 2010 043 092 | A1 | 5/2012 |
| EP | 1 967 726 | A2 | 9/2008 |
| EP | 2 278 152 | A1 | 1/2011 |
| JP | 60-131663 | U | 9/1985 |
| JP | 8-35462 | A | 2/1996 |
| JP | 2000-18135 | A | 1/2000 |
| JP | 2002-515565 | A | 5/2002 |
| JP | 2008-138650 | A | 6/2008 |
| WO | 02/23036 | A1 | 3/2002 |
| WO | 2012/055638 | A1 | 5/2012 |

OTHER PUBLICATIONS

Gamer, Bryan A., The Redbook: A Manual on Legal Style, Section 10.42, Thompson/West, Second Edition (2006).

* cited by examiner

PRESSURE CONTROL VALVE FOR A FUEL INJECTION SYSTEM

This application is a 35 U.S.C. § 371 National Stage Application of PCT/EP2013/073294, filed on Nov. 7, 2013, which claims the benefit of priority to Ser. No. DE 10 2012 224 403.4, filed on Dec. 27, 2012 in Germany, the disclosures of which are incorporated herein by reference in their entirety.

The disclosure relates to a pressure control valve for a fuel injection system, in particular a common rail injection system, for controlling the pressure in a high-pressure fuel accumulator.

BACKGROUND

A pressure control valve of the abovementioned type comprises a valve housing in which a solenoid actuator and an armature which interacts with the solenoid actuator are accommodated, and also comprises a valve piece which is connected to the valve housing. In the valve housing there is formed a normally conical valve seat which interacts with the spherical valve closing element. The armature has an armature pin or armature bolt which serves as force transmission element and which acts on the spherical valve closing element in such a way that, when the solenoid actuator is energized, said valve closing element is pushed by way of the armature pin or armature bolt against the valve seat. The armature pin or the armature bolt generally has a spherical cap-shaped receptacle for the radial guidance of the spherical valve closing element, said receptacle being produced by stamping. Since the armature pin or armature bolt is guided in the valve housing, overdeterminacy of the spherical valve closing element in the closed position of the valve may arise if there is an axial offset between the guide in the valve housing and the valve seat by way of the spherical cap-shaped stamped formation. During the opening of the valve, a radial offset is then generated which, upon closing, has the effect that the spherical valve closing element slides back into the sealing seat over the conical surface of the valve seat (closing hysteresis). This results in a pressure difference between the opening and closing pressures, and undesired generation of noise.

A pressure control valve of the above-stated type emerges from the laid-open specification DE 10 2010 043 092 A1, which pressure control valve, for the compensation of any axial offset between the guide of the armature bolt and the valve seat, has an armature bolt formed in at least two parts. The armature bolt preferably comprises a transmission rod and a thrust piece which, for the compensation of any axial offset, is received in radially displaceable fashion in the transmission rod. Undesired generation of noise however cannot be prevented in an effective manner in this way.

The disclosure is based on the object of specifying a pressure control valve which does not have the abovementioned disadvantages.

To achieve the object, a pressure control valve having the features described herein is proposed. Advantageous further developments of the disclosure emerge from the subclaims.

SUMMARY

The proposed pressure control valve comprises a solenoid actuator for the actuation of a spherical valve closing element, wherein the solenoid actuator interacts with an armature which can perform a stroke movement and which is connected to an armature pin for the transmission of the force of the solenoid actuator to the spherical valve closing element. According to the disclosure, the spherical valve closing element and/or the armature pin are/is guided in axially displaceable fashion in a valve piece which interacts with the spherical valve closing element. It is preferably the case that at least the spherical valve closing element is guided in axially displaceable fashion by way of the valve piece such that it can no longer perform any radial movement during the opening or closing processes. In this way, undesired noises generated in the event of a radial movement of the valve closing element are prevented in an effective manner. Furthermore, it is ensured that closing hysteresis does not arise, because a radial offset of the spherical valve closing element with respect to the valve seat is no longer possible. Furthermore, it is preferably additionally the case that the armature pin is guided in axially displaceable fashion by way of the valve piece. The guidance of the armature pin and of the spherical valve closing element is accordingly realized by way of one and the same component. This does not rule out a situation in which the armature pin is furthermore guided in axially displaceable fashion in a further component of the pressure control valve, for example in a valve housing of the valve. If an axial offset between the guide in the valve housing and the valve seat should arise, this is compensated by way of the guide, which is situated closer to the valve seat, in the valve piece.

Owing to the guidance of the spherical valve closing element and/or of the armature pin on the valve piece, a spherical cap-shaped stamped formation in the armature pin can be dispensed with. This simplifies the production of the proposed pressure control valve.

In a preferred embodiment of the disclosure, the valve piece has at least two guide surfaces which delimit the radial movement clearance of the spherical valve closing element and/or of the armature pin. The number of guide surfaces may be an even number or an odd number. In the case of an even number of guide surfaces, it is preferably the case that at least two of the guide surfaces which delimit the radial movement clearance of the spherical valve closing element and/or of the armature pin are situated opposite one another. Said guide surfaces are then oriented parallel to one another.

Furthermore, it is preferably the case that at least two guide surfaces directly adjoin the valve seat, which is preferably of conical form. That is to say, the guide surfaces extend out of the valve seat. To limit the radial movement clearance of the spherical valve closing element and/or of the armature pin, the guide surfaces are oriented axially. The axially running guide surfaces accordingly preferably stand on the conical surface of the valve seat.

The spherical valve closing element is preferably guided by way of the guide surfaces which directly adjoin the valve seat. For the guidance of the armature pin, which has a larger outer diameter than the spherical valve closing element, there are furthermore preferably provided guide surfaces which are arranged so as to be situated radially further to the outside in relation to the guide surfaces directly adjoining the valve seat.

In a further preferred embodiment, the guide surfaces for guiding the spherical valve closing element and/or the armature pin are formed on radially running webs. Those face surfaces of the webs which face toward the valve seat form the guide surfaces. The radially running webs are preferably arranged at uniform angular intervals with respect to one another. The angular interval—in each case in relation to the central axes of the webs—is 120° in the case of three webs, is 90° in the case of four webs, etc. Accordingly, four webs are preferably arranged in a cross shape, and five webs are arranged in a star shape, wherein the webs—by contrast to a cross or a star—do not cross one another.

Alternatively or in addition, it is provided that the webs delimit flow ducts. That is to say that the free spaces between the webs can be utilized as flow ducts in order to ensure the outflow of a spill quantity discharged from the pressure control valve.

As a refining measure, it is proposed that at least a part of the flow ducts is hydraulically connected to an armature chamber. The armature chamber is accordingly connected by way of at least one flow duct to a valve chamber, formed in the valve piece, or of the pressure control valve. The connection permits pressure equalization between the valve chamber and armature chamber.

In a cross section through the valve piece, the guide surfaces for the guidance of the spherical valve element and/or of the armature pin preferably form tangents to the outer diameter of the spherical valve closing element and/or of the armature pin. The spherical valve closing element accordingly has a punctiform contact region (see reference character 24 in FIG. 3), and the cylindrical armature pin has a linear contact region, with the respectively associated guide surfaces. The contact region is thus reduced to a minimum.

The valve piece is advantageously a metal injection molded part. As such, it has been produced in a metal injection molding (MIM for short) process. The use of such a method simplifies the production of the valve piece including the guide surfaces.

The valve piece advantageously has a biting edge on a support surface averted from the valve seat. The support surface serves for supporting the valve piece or the pressure control valve during the insertion into a stepped bore of a high-pressure accumulator body. A sealing action can be realized by way of the biting edge.

In a preferred embodiment, the proposed pressure control valve is configured as a 2/2 directional valve. In this embodiment, the pressure control valve is suitable in particular for use in a high-pressure fuel accumulator. In an open position of the pressure control valve, a connection of the high-pressure accumulator to a return line is produced, such that the pressure in the high-pressure accumulator can be reduced. In a closed position of the pressure control valve, the connection of the high-pressure accumulator to the return line is shut off, such that pressure can be built up.

BRIEF DESCRIPTION OF THE DRAWINGS

A preferred embodiment will be discussed in more detail below on the basis of the appended drawings, in which.

DETAILED DESCRIPTION

Figure 1:
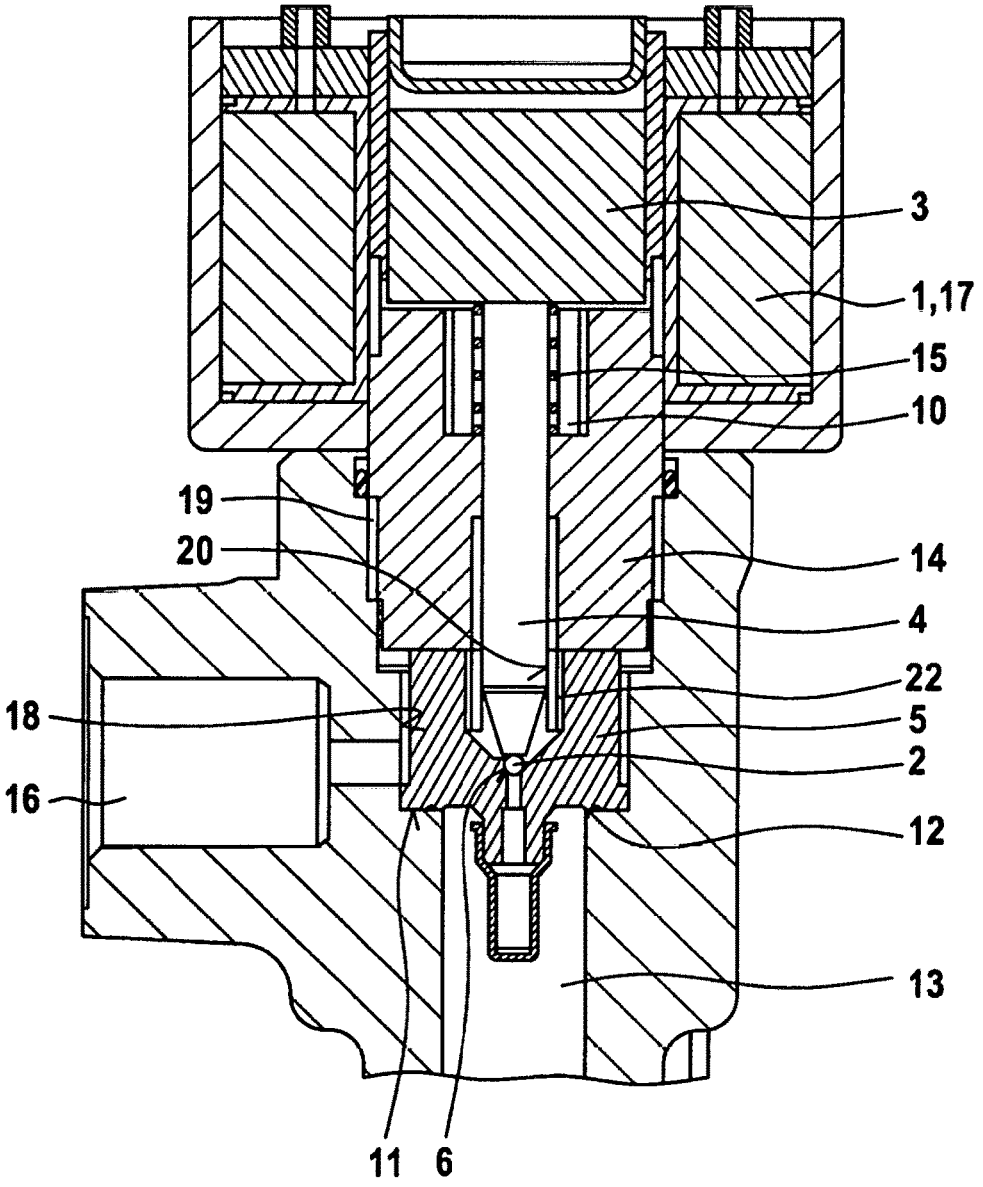
FIG. 1 shows a longitudinal section through a preferred embodiment of a pressure control valve according to the disclosure.

The pressure control valve illustrated in FIG. 1 comprises a solenoid actuator 1 which has an annular magnet coil 17 and which interacts with an armature 3 which can perform a stroke movement, and which in the present case is in the form of a solenoid plunger. The armature 3 is connected to an armature pin 4 which, as force transmission element, transmits the force of the solenoid actuator 1 to a spherical valve closing element 2 when the solenoid actuator 1 is activated, that is to say the magnet coil 17 is energized. In this case, the armature 3 including the armature pin 4 are moved, counter to the spring force of a spring 15, in the direction of the spherical valve closing element 2. There, the armature pin 4 presses the spherical valve closing element 2 against a conical valve seat 6, such that the pressure control valve is closed and no connection between a high-pressure accumulator 13 and a return port 16 is produced. If the pressure in the high-pressure accumulator 13 rises beyond a predefined threshold, the energization of the magnet coil 17 is ended, such that the spring force of the spring 15 effects a return movement of the armature 3 including the armature pin 4 and the valve is opened by way of the pressure acting on the spherical valve closing element.

In the present case, the pressure control valve is received in a stepped bore 18 of the high-pressure accumulator 13 and is connected to the latter by way of a screw connection 19. For this purpose, there is formed on a valve housing 14 of the pressure control valve an external thread which can be connected to an internal thread of the stepped bore 18. By way of the screw connection 19, the pressure control valve can be axially preloaded against the high-pressure accumulator, wherein the pressure control valve is supported by way of a support surface 11 of a valve piece 5 against a step of the stepped bore 18. A biting edge 12 formed in the region of the support surface 11 seals off the high-pressure accumulator 13 to the outside.

Figure 2:
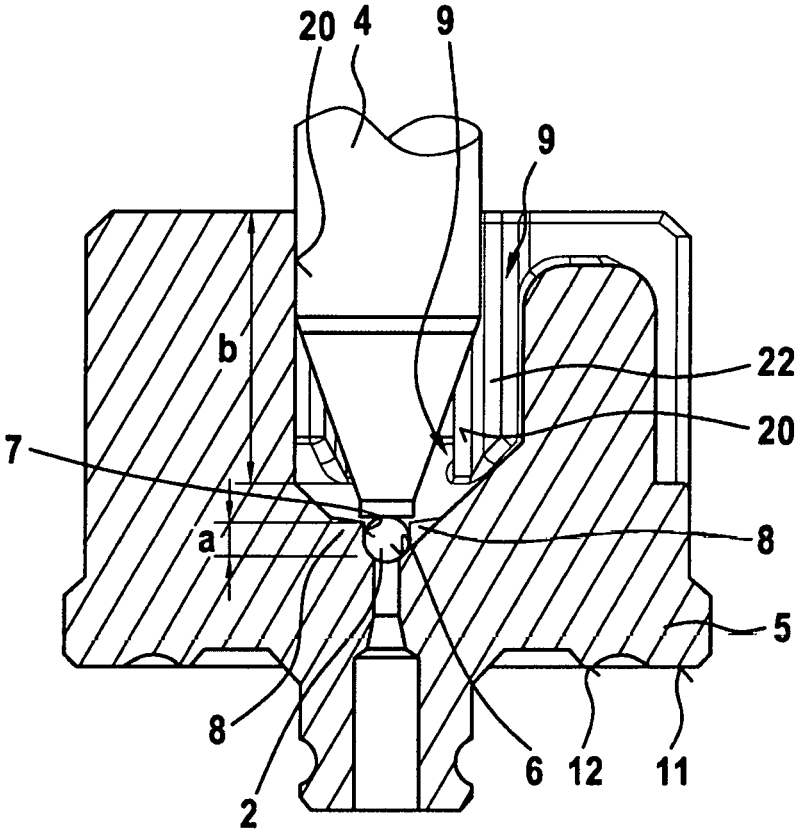
FIG. 2 shows an enlarged detail from FIG. 1 in the region of the valve piece.
Figure 3:
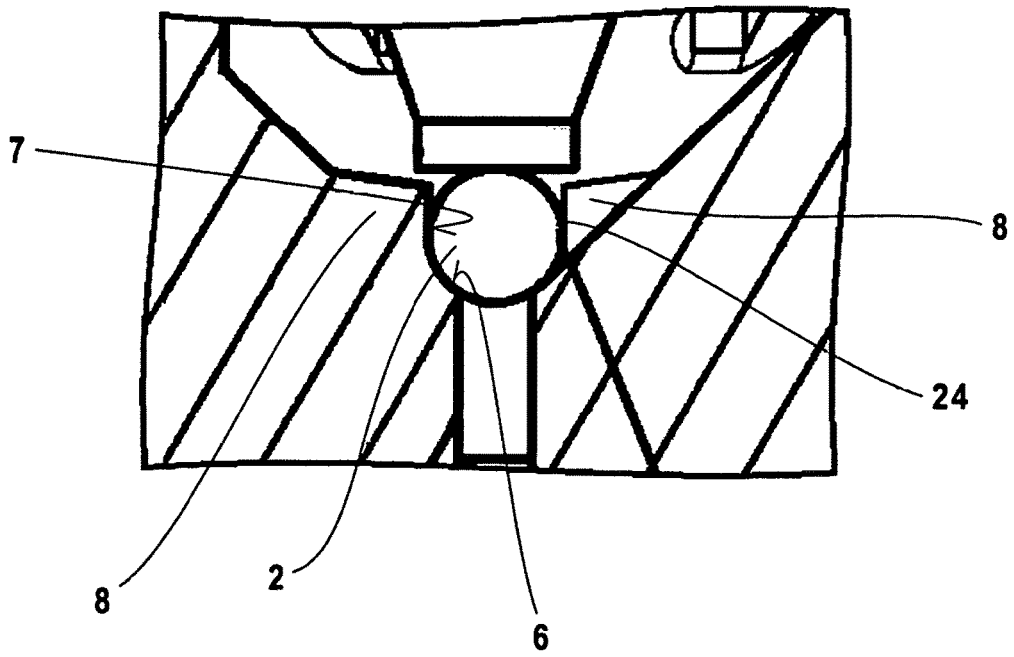
FIG. 3 shows a further enlarged detail from FIG. 1 in the region of the spherical valve closing element.

As can be seen from FIG. 2, the valve piece 5, which also forms the valve seat 6, has a first guide region a for the guidance of the spherical valve closing element 2 and has a second guide region b for the guidance of the armature pin 4. The guidance is effected in each case by way of five guide surfaces 7, 20 which are each formed by five webs 8, 22, said webs being arranged in a star shape around the valve seat 6. The five webs 8, 22 of the guide regions a, b are arranged in each case at uniform angular intervals with respect to one another, such that, between the webs 8, 22, there are formed flow ducts 9 which are hydraulically connected (see FIG. 1) to an armature chamber 10. Since the spherical valve closing element 2 has a smaller diameter than the armature pin 4, the guide surfaces 7 for guiding the spherical valve closing element 2 are situated radially further toward the inside than the guide surfaces 20 which serve for the guidance of the armature pin 4. The guide surfaces 20 for the guidance of the armature pin 4 are formed by separate webs 22 which, in the present case, are arranged in the same angular positions as the webs 8 for forming the guide surfaces 7 for guiding the spherical valve closing element 2. In this way, the flow ducts 9 formed in each case between the webs 8, 22 overlap.

As can also be seen from FIG. 2, the webs 8 including the guide surfaces 7 of the guide region a directly adjoin the conical surface of the valve seat 6. In effect, said webs rise out of the valve seat surface. The conical surface of the valve seat 6 extends beyond this, such that the webs 22 of the guide region b also rise out of the conical surface of the valve seat 6. Accordingly, the webs 8, 22 of the two guide regions a, b are connected by way of the conical surface.

The invention claimed is:

1. A pressure control valve for a fuel injection system configured to control a pressure in a high-pressure fuel accumulator, comprising:

a spherical valve closing element;

a valve piece defining a valve seat with a conical form, the valve seat configured to interact with the spherical valve closing element, the valve piece formed as a one-piece, unitary body; and a solenoid actuator configured to actuate the spherical valve closing element, and to interact with an armature configured to perform a stroke movement, the armature connected to an armature pin and configured to transmit a force of the solenoid actuator to the spherical valve closing element, wherein the valve piece further defines a first guide region and a second guide region arranged axially above the first guide region, the spherical valve closing element guided in an axially displaceable direction in the valve piece by the first guide region, the armature pin guided in the axially displaceable direction in the valve piece by the second guide region, wherein the first guide region has at least two first guide surfaces configured to delimit a radial movement of the spherical valve closing element, wherein the second guide region has at least two second guide surfaces configured to delimit a radial movement of the armature pin, and wherein the at least two first guide surfaces directly adjoin the valve seat via first radially running webs.

2. The pressure control valve as claimed in claim 1, wherein:

the at least two second guide surfaces are formed on second radially running webs, and the first radially running webs and the second radially running webs delimit flow ducts.

3. The pressure control valve as claimed in claim 2, wherein at least a part of the flow ducts is hydraulically connected to an armature chamber.

4. The pressure control valve as claimed in claim 1, wherein in a cross section of the valve piece, the at least two first guide surfaces form tangents to an outer diameter of the spherical valve closing element, and the at least two second guide surfaces form tangents to an outer diameter of the armature pin.

5. The pressure control valve as claimed in claim 1, wherein the valve piece is a metal injection molded part.

6. The pressure control valve as claimed in claim 1, wherein the valve piece has a biting edge on a support surface averted from the valve seat.

7. The pressure control valve as claimed in claim 1, wherein the pressure control valve is configured as a 2/2 directional valve.

8. The pressure control valve as claimed in claim 1, wherein:

the at least two second guide surfaces are formed on second radially running webs, and the first radially running webs are connected to the second radially running webs via a conical surface of the valve seat.

9. The pressure control valve as claimed in claim 1, wherein:

the at least two second guide surfaces are formed on second radially running webs, and the first radially running webs and the second radially running webs are arranged at uniform angular intervals with respect to one another.

10. The pressure control valve as claimed in claim 9, wherein the first radially running webs and the second radially running webs delimit flow ducts.

11. The pressure control valve as claimed in claim 2, further comprising a valve housing interposed between the valve piece and the armature, the valve housing formed as a one-piece, unitary body, wherein the valve piece defines a valve chamber and the valve housing defines an armature chamber spaced from valve chamber, the armature chamber hydraulically connected to the valve chamber via the flow ducts.

12. The pressure control valve as claimed in claim 4, wherein:

the spherical valve closing element has a punctiform contact region with at least one of the at least two first guide surfaces when the spherical valve closing element is guided by the first guide region, and the armature pin has a linear contact region with at least one of the at least two second guide surfaces when the armature pin is guided by the second guide region.

13. A pressure control valve for a fuel injection system configured to control a pressure in a high-pressure fuel accumulator, comprising:

a spherical valve closing element;

a valve piece defining a valve seat with a conical form, the valve seat configured to interact with the spherical valve closing element, the valve piece formed as a one-piece, unitary body; and a solenoid actuator configured to actuate the spherical valve closing element, and to interact with an armature configured to perform a stroke movement, the armature connected to an armature pin and configured to transmit a force of the solenoid actuator to the spherical valve closing element, wherein the valve piece further defines a first guide region and a second guide region arranged axially above the first guide region, the spherical valve closing element guided in an axially displaceable direction in the valve piece by the first guide region, the armature pin guided in the axially displaceable direction in the valve piece by the second guide region, wherein the first guide region has at least two first guide surfaces configured to delimit a radial movement clearance of the spherical valve closing element, wherein the second guide region has at least two second guide surfaces configured to delimit a radial movement clearance of the armature pin, wherein the at least two first guide surfaces directly adjoin the valve seat via first radially running webs, wherein the at least two second guide surfaces are formed on second radially running webs, and wherein the first radially running webs and the second radially running webs are arranged at uniform angular intervals with respect to one another.

14. A pressure control valve for a fuel injection system configured to control a pressure in a high-pressure fuel accumulator, comprising:

a spherical valve closing element;

a valve piece defining a valve seat with a conical form, the valve seat configured to interact with the spherical valve closing element, the valve piece formed as a one-piece, unitary body;

a solenoid actuator configured to actuate the spherical valve closing element, and to interact with an armature configured to perform a stroke movement, the armature connected to an armature pin and configured to transmit a force of the solenoid actuator to the spherical valve closing element; and a valve housing interposed between the valve piece and the armature, the valve housing formed as a one-piece, unitary body, wherein the valve piece further defines a first guide region and a second guide region arranged axially above the first guide region, the spherical valve closing element guided in an axially displaceable direction in the valve piece by the first guide region, the armature pin guided in the axially displaceable direction in the valve piece by the second guide region, wherein the first guide region has at least two first guide surfaces configured to delimit a radial movement clearance of the spherical valve closing element, and wherein the second guide region has at least two second guide surfaces configured to delimit a radial movement clearance of the armature pin, wherein the at least two first guide surfaces directly adjoin the valve seat via first radially running webs, wherein the at least two second guide surfaces are formed on second radially running webs, wherein the first radially running webs and the second radially running webs delimit flow ducts, and wherein the valve piece defines a valve chamber and the valve housing defines an armature chamber spaced from valve chamber, the armature chamber hydraulically connected to the valve chamber via the flow ducts.

* * * * *